US011261731B1

(12) United States Patent
Sollami

(10) Patent No.: US 11,261,731 B1
(45) **Date of Patent: *Mar. 1, 2022**

(54) BIT HOLDER AND UNITARY BIT/HOLDER FOR USE IN SHORTENED DEPTH BASE BLOCKS

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 137 days.

This patent is subject to a terminal disclaimer.

(21) Appl. No.: 15/699,504

(22) Filed: Sep. 8, 2017

Related U.S. Application Data

(63) Continuation-in-part of application No. 14/690,679, filed on Apr. 20, 2015, now Pat. No. 10,370,966, and a continuation-in-part of application No. 14/959,551, filed on Dec. 4, 2015, now Pat. No. 10,337,324.

(60) Provisional application No. 61/983,291, filed on Apr. 23, 2014, provisional application No. 62/100,764, filed on Jan. 7, 2015.

(51) Int. Cl.
*E21C 35/19* (2006.01)
*B28D 1/18* (2006.01)
*E21C 35/183* (2006.01)

(52) U.S. Cl.
CPC ..... *E21C 35/19* (2013.01); *B28D 1/188* (2013.01); *E21C 35/191* (2020.05); *E21C 35/1831* (2020.05)

(58) Field of Classification Search
CPC ..... E21C 35/19; E21C 2035/191; E21C 2035/1826; E21C 35/197; B28D 1/188
See application file for complete search history.

(56) References Cited

U.S. PATENT DOCUMENTS

| | | | |
|---|---|---|---|
| 2,382,947 | A | 7/1944 | Brozek |
| 2,810,567 | A | 10/1957 | Kirkham |
| 3,342,531 | A | 9/1967 | Krekeler |
| 3,342,532 | A | 9/1967 | Krekeler |
| 3,397,012 | A | 8/1968 | Krekeler |
| 3,476,438 | A | 11/1969 | Bower, Jr. |

(Continued)

FOREIGN PATENT DOCUMENTS

| | | |
|---|---|---|
| DE | 102004049710 | 4/2006 |
| DE | 102011079115 | 1/2013 |

(Continued)

*Primary Examiner* — Janine M Kreck
*Assistant Examiner* — Michael A Goodwin
(74) *Attorney, Agent, or Firm* — Mercedes V. O'Connor; Rockman Videbeck & O'Connor

(57) ABSTRACT

A bit assembly includes a base block and a bit holder having a body portion and a shank. The body portion and the shank being coaxial and including a bore extending from a forward end of the body portion to the distal end of the shank. The shank further includes at least two segments, a first segment and a second segment. The second segment is subject to the first segment and includes a taper towards the top segment. The base block includes a base and a shortened front end. The shortened front end having a forward face and a rear face. The forward face including an indentation and the rear face including a slot extending axially inward from the rear face to a position mediate the forward face.

31 Claims, 12 Drawing Sheets

(56) References Cited

U.S. PATENT DOCUMENTS

| | | | |
|---|---|---|---|
| 3,519,309 | A | 7/1970 | Engle |
| 3,833,264 | A | 9/1974 | Elders |
| 3,833,265 | A | 9/1974 | Elders |
| 3,865,437 | A | 2/1975 | Crosby |
| 4,084,856 | A | 4/1978 | Emmerich |
| 4,247,150 | A | 1/1981 | Wrulich et al. |
| RE30,807 | E | 12/1981 | Elders |
| 4,310,939 | A | 1/1982 | Iijima |
| 4,453,775 | A | 6/1984 | Clemmow |
| 4,478,298 | A | 10/1984 | Hake |
| 4,489,986 | A | 12/1984 | Dziak |
| 4,525,178 | A | 6/1985 | Hall |
| 4,561,698 | A | 12/1985 | Beebe |
| 4,570,726 | A | 2/1986 | Hall |
| 4,604,106 | A | 8/1986 | Hall |
| 4,632,463 | A | 12/1986 | Sterwerf, Jr. |
| 4,694,918 | A | 9/1987 | Hall |
| 4,702,525 | A | 10/1987 | Sollami |
| 4,763,956 | A | 8/1988 | Emmerich |
| 4,811,801 | A | 3/1989 | Salesky |
| 4,818,027 | A | 4/1989 | Simon |
| 4,821,819 | A | 4/1989 | Whysong |
| 4,844,550 | A | 7/1989 | Beebe |
| 4,915,455 | A | 4/1990 | O'Niell |
| 4,944,559 | A | 7/1990 | Sionett |
| 5,067,775 | A | 11/1991 | D'Angelo |
| 5,088,797 | A | 2/1992 | O'Neill |
| 5,098,167 | A | 3/1992 | Latham |
| 5,159,233 | A | 10/1992 | Sponseller |
| 5,161,627 | A | 11/1992 | Burkett |
| 5,273,343 | A | 12/1993 | Ojanen |
| 5,287,937 | A | 2/1994 | Sollami |
| 5,302,005 | A | 4/1994 | O'Neill |
| 5,303,984 | A | 4/1994 | Ojanen |
| 5,352,079 | A | 10/1994 | Croskey |
| 5,370,448 | A | 12/1994 | Sterwerf, Jr. |
| 5,374,111 | A | 12/1994 | Den Besten |
| 5,415,462 | A | 5/1995 | Massa |
| 5,417,475 | A | 5/1995 | Graham et al. |
| 5,458,210 | A | 10/1995 | Sollami |
| 5,484,191 | A | 1/1996 | Sollami |
| 5,492,188 | A | 2/1996 | Smith et al. |
| 5,551,760 | A | 9/1996 | Sollami |
| 5,607,206 | A | 3/1997 | Siddle |
| 5,628,549 | A | 5/1997 | Ritchey |
| 5,720,528 | A | 2/1998 | Ritchey |
| 5,725,283 | A | 3/1998 | O'Neill |
| 5,823,632 | A | 10/1998 | Burkett |
| 5,924,501 | A | 7/1999 | Tibbitts |
| 5,931,542 | A | 8/1999 | Britzke |
| 5,934,854 | A | 8/1999 | Krautkremer et al. |
| 5,992,405 | A | 11/1999 | Sollami |
| D420,013 | S | 2/2000 | Warren |
| 6,019,434 | A | 2/2000 | Emmerich |
| 6,102,486 | A | 8/2000 | Briese |
| 6,176,552 | B1 | 1/2001 | Topka, Jr. |
| 6,196,340 | B1 | 3/2001 | Jensen et al. |
| 6,199,451 | B1 | 3/2001 | Sollami |
| 6,250,535 | B1 | 6/2001 | Sollami |
| 6,331,035 | B1 | 12/2001 | Montgomery, Jr. |
| 6,341,823 | B1 | 1/2002 | Sollami |
| 6,357,832 | B1 | 3/2002 | Sollami |
| 6,371,567 | B1 | 4/2002 | Sollami |
| 6,382,733 | B1 | 5/2002 | Parrott |
| 6,428,110 | B1 | 8/2002 | Ritchey et al. |
| 6,508,516 | B1 | 1/2003 | Kammerer |
| D471,211 | S | 3/2003 | Sollami |
| 6,585,326 | B2 | 7/2003 | Sollami |
| 6,685,273 | B1 | 2/2004 | Sollami |
| 6,692,083 | B2 | 2/2004 | Latham |
| D488,170 | S | 4/2004 | Sollami |
| 6,733,087 | B2 | 5/2004 | Hall |
| 6,739,327 | B2 | 5/2004 | Sollami |
| 6,786,557 | B2 | 9/2004 | Montgomery |
| 6,824,225 | B2 | 11/2004 | Stiffler |
| 6,846,045 | B2 | 1/2005 | Sollami |
| 6,854,810 | B2 | 2/2005 | Montgomery |
| 6,866,343 | B2 | 3/2005 | Holl et al. |
| 6,968,912 | B2 | 11/2005 | Sollami |
| 6,994,404 | B1 | 2/2006 | Sollami |
| 7,097,258 | B2 | 8/2006 | Sollami |
| 7,118,181 | B2 | 10/2006 | Frear |
| 7,150,505 | B2 | 12/2006 | Sollami |
| 7,195,321 | B1 | 3/2007 | Sollami |
| 7,210,744 | B2 | 5/2007 | Montgomery |
| 7,229,136 | B2 | 6/2007 | Sollami |
| 7,234,782 | B2 | 6/2007 | Stehney |
| D554,162 | S | 10/2007 | Hall |
| 7,320,505 | B1 | 1/2008 | Hall |
| 7,338,135 | B1 | 3/2008 | Hall |
| 7,347,292 | B1 | 3/2008 | Hall |
| D566,137 | S | 4/2008 | Hall |
| 7,353,893 | B1 | 4/2008 | Hall |
| 7,384,105 | B2 | 6/2008 | Hall |
| 7,396,086 | B1 | 6/2008 | Hall |
| 7,401,862 | B2 | 7/2008 | Holl et al. |
| 7,401,863 | B1 | 7/2008 | Hall |
| 7,410,221 | B2 | 8/2008 | Hall |
| 7,413,256 | B2 | 8/2008 | Hall |
| 7,413,258 | B2 | 8/2008 | Hall |
| 7,419,224 | B2 | 9/2008 | Hall |
| 7,445,294 | B2 | 11/2008 | Hall |
| D581,952 | S | 12/2008 | Hall |
| 7,464,993 | B2 | 12/2008 | Hall |
| 7,469,756 | B2 | 12/2008 | Hall |
| 7,469,971 | B2 | 12/2008 | Hall |
| 7,469,972 | B2 | 12/2008 | Hall |
| 7,475,948 | B2 | 1/2009 | Hall |
| 7,523,794 | B2 | 4/2009 | Hall |
| 7,568,770 | B2 | 8/2009 | Hall |
| 7,569,249 | B2 | 8/2009 | Hall |
| 7,571,782 | B2 | 8/2009 | Hall |
| 7,575,425 | B2 | 8/2009 | Hall |
| 7,588,102 | B2 | 9/2009 | Hall |
| 7,594,703 | B2 | 9/2009 | Hall |
| 7,600,544 | B1 | 10/2009 | Sollami |
| 7,600,823 | B2 | 10/2009 | Hall |
| 7,628,233 | B1 | 12/2009 | Hall |
| 7,635,168 | B2 | 12/2009 | Hall |
| 7,637,574 | B2 | 12/2009 | Hall |
| 7,648,210 | B2 | 1/2010 | Hall |
| 7,665,552 | B2 | 2/2010 | Hall |
| 7,669,938 | B2 | 3/2010 | Hall |
| 7,681,338 | B2 | 3/2010 | Hall |
| 7,712,693 | B2 | 5/2010 | Hall |
| 7,717,365 | B2 | 5/2010 | Hall |
| 7,722,127 | B2 | 5/2010 | Hall |
| 7,789,468 | B2 | 9/2010 | Sollami |
| 7,832,808 | B2 | 11/2010 | Hall |
| 7,883,155 | B2 | 2/2011 | Sollami |
| 7,950,745 | B2 | 5/2011 | Sollami |
| 7,963,617 | B2 | 6/2011 | Hall |
| 7,992,944 | B2 | 8/2011 | Hall |
| 7,992,945 | B2 | 8/2011 | Hall |
| 7,997,660 | B2 | 8/2011 | Monyak et al. |
| 7,997,661 | B2 | 8/2011 | Hall |
| 8,007,049 | B2 | 8/2011 | Fader |
| 8,007,051 | B2 | 8/2011 | Hall |
| 8,029,068 | B2 | 10/2011 | Hall |
| 8,033,615 | B2 | 10/2011 | Hall |
| 8,033,616 | B2 | 10/2011 | Hall |
| 8,038,223 | B2 | 10/2011 | Hall |
| 8,061,784 | B2 | 11/2011 | Hall |
| 8,109,349 | B2 | 2/2012 | Hall |
| 8,118,371 | B2 | 2/2012 | Hall |
| 8,136,887 | B2 | 3/2012 | Hall |
| 8,201,892 | B2 | 6/2012 | Hall |
| 8,215,420 | B2 | 7/2012 | Hall |
| 8,292,372 | B2 | 10/2012 | Hall |
| 8,414,085 | B2 | 4/2013 | Hall |
| 8,449,039 | B2 | 5/2013 | Hall |
| 8,485,609 | B2 | 7/2013 | Hall |
| 8,500,209 | B2 | 8/2013 | Hall |
| 8,540,320 | B2 | 9/2013 | Sollami |

(56) References Cited

U.S. PATENT DOCUMENTS

| | | | | |
|---|---|---|---|---|
| RE44,690 | E | 1/2014 | Sollami | |
| 8,622,482 | B2 | 1/2014 | Sollami | |
| 8,622,483 | B2 | 1/2014 | Sollami | |
| 8,646,848 | B2 | 2/2014 | Hall | |
| 8,728,382 | B2 | 5/2014 | Hall | |
| 9,004,610 | B2 | 4/2015 | Erdmann et al. | |
| 9,028,008 | B1 | 5/2015 | Bookhamer | |
| 9,039,099 | B2 | 5/2015 | Sollami | |
| 9,316,061 | B2 | 4/2016 | Hall | |
| 9,518,464 | B2 | 12/2016 | Sollami | |
| 9,879,531 | B2 | 1/2018 | Sollami | |
| 9,909,416 | B1 | 3/2018 | Sollami | |
| 9,976,418 | B2 | 5/2018 | Sollami | |
| 9,988,903 | B2 | 6/2018 | Sollami | |
| 10,072,501 | B2 | 9/2018 | Sollami | |
| 10,105,870 | B1 | 10/2018 | Sollami | |
| 10,107,097 | B1 | 10/2018 | Sollami | |
| 10,107,098 | B2 | 10/2018 | Sollami | |
| 10,180,065 | B1 | 1/2019 | Sollami | |
| 10,260,342 | B1 | 4/2019 | Sollami | |
| 10,323,515 | B1 | 6/2019 | Sollami | |
| 10,337,324 | B2 | 7/2019 | Sollami | |
| 10,370,966 | B1 | 8/2019 | Sollami | |
| 10,385,689 | B1 | 8/2019 | Sollami | |
| 10,415,386 | B1 | 9/2019 | Sollami | |
| 10,502,056 | B2 | 12/2019 | Sollami | |
| 2002/0063467 | A1 | 5/2002 | Taitt | |
| 2002/0074850 | A1 | 6/2002 | Montgomery, Jr. | |
| 2002/0074851 | A1 | 6/2002 | Montgomery, Jr. | |
| 2002/0109395 | A1* | 8/2002 | Sollami | B28D 1/188 299/106 |
| 2002/0167216 | A1 | 11/2002 | Sollami | |
| 2002/0192025 | A1 | 12/2002 | Johnson | |
| 2003/0015907 | A1 | 1/2003 | Sollami | |
| 2003/0047985 | A1 | 3/2003 | Stiffler | |
| 2003/0052530 | A1 | 3/2003 | Sollami | |
| 2003/0122414 | A1 | 7/2003 | Sollami | |
| 2003/0209366 | A1 | 11/2003 | McAlvain | |
| 2004/0004389 | A1 | 1/2004 | Latham | |
| 2004/0174065 | A1 | 9/2004 | Sollami | |
| 2005/0212345 | A1 | 9/2005 | Sleep et al. | |
| 2006/0071538 | A1 | 4/2006 | Sollami | |
| 2006/0186724 | A1 | 8/2006 | Stehney | |
| 2006/0261663 | A1 | 11/2006 | Sollami | |
| 2007/0013224 | A1 | 1/2007 | Stehney | |
| 2007/0040442 | A1 | 2/2007 | Weaver | |
| 2007/0052279 | A1 | 3/2007 | Sollami | |
| 2008/0035386 | A1 | 2/2008 | Hall et al. | |
| 2008/0036276 | A1* | 2/2008 | Hall | E21C 35/183 299/104 |
| 2008/0036283 | A1 | 2/2008 | Hall et al. | |
| 2008/0100124 | A1 | 5/2008 | Hall et al. | |
| 2008/0145686 | A1 | 6/2008 | Mirchandani | |
| 2008/0164747 | A1 | 7/2008 | Weaver et al. | |
| 2008/0284234 | A1 | 11/2008 | Hall et al. | |
| 2009/0146491 | A1 | 6/2009 | Fader et al. | |
| 2009/0160238 | A1 | 6/2009 | Hall et al. | |
| 2009/0256413 | A1 | 10/2009 | Majagi | |
| 2009/0261646 | A1 | 10/2009 | Ritchie et al. | |
| 2010/0045094 | A1* | 2/2010 | Sollami | E21C 35/18 299/102 |
| 2010/0244545 | A1 | 9/2010 | Hall | |
| 2010/0253130 | A1 | 10/2010 | Sollami | |
| 2010/0320003 | A1 | 12/2010 | Sollami | |
| 2010/0320829 | A1 | 12/2010 | Sollami | |
| 2011/0006588 | A1 | 1/2011 | Monyak et al. | |
| 2011/0089747 | A1 | 4/2011 | Helsel | |
| 2011/0175430 | A1 | 7/2011 | Heiderich et al. | |
| 2011/0204703 | A1 | 8/2011 | Sollami | |
| 2011/0254350 | A1 | 10/2011 | Hall | |
| 2012/0001475 | A1 | 1/2012 | Dubay et al. | |
| 2012/0027514 | A1 | 2/2012 | Hall | |
| 2012/0056465 | A1 | 3/2012 | Gerer et al. | |
| 2012/0068527 | A1 | 3/2012 | Erdmann | |
| 2012/0104830 | A1 | 5/2012 | Monyak et al. | |
| 2012/0181845 | A1 | 7/2012 | Sollami | |
| 2012/0242136 | A1 | 9/2012 | Ojanen | |
| 2012/0248663 | A1 | 10/2012 | Hall | |
| 2012/0261977 | A1 | 10/2012 | Hall | |
| 2012/0280559 | A1 | 11/2012 | Watson | |
| 2012/0286559 | A1 | 11/2012 | Sollami | |
| 2012/0319454 | A1 | 12/2012 | Swope | |
| 2013/0169023 | A1 | 7/2013 | Monyak | |
| 2013/0181501 | A1 | 7/2013 | Hall et al. | |
| 2013/0199693 | A1 | 8/2013 | Tank et al. | |
| 2013/0307316 | A1 | 11/2013 | Roetsch et al. | |
| 2014/0035346 | A1* | 2/2014 | Fundakowski | E21C 25/10 299/87.1 |
| 2014/0110991 | A1 | 4/2014 | Sollami | |
| 2014/0232172 | A1 | 8/2014 | Roth et al. | |
| 2014/0262541 | A1 | 9/2014 | Parsana et al. | |
| 2014/0326516 | A1 | 11/2014 | Haugvaldstad | |
| 2015/0028656 | A1 | 1/2015 | Sollami | |
| 2015/0035343 | A1 | 2/2015 | Ojanen | |
| 2015/0137579 | A1 | 5/2015 | Lachmann et al. | |
| 2015/0198040 | A1 | 7/2015 | Voitic et al. | |
| 2015/0240634 | A1 | 8/2015 | Sollami | |
| 2015/0285074 | A1 | 10/2015 | Sollami | |
| 2015/0292325 | A1 | 10/2015 | Sollami | |
| 2015/0300166 | A1 | 10/2015 | Ries et al. | |
| 2015/0308488 | A1 | 10/2015 | Kahl | |
| 2015/0315910 | A1 | 11/2015 | Sollami | |
| 2015/0354285 | A1 | 12/2015 | Hall | |
| 2016/0102550 | A1 | 4/2016 | Paros et al. | |
| 2016/0194956 | A1 | 7/2016 | Sollami | |
| 2016/0229084 | A1 | 8/2016 | Lehnert | |
| 2016/0237818 | A1 | 8/2016 | Weber et al. | |
| 2017/0089198 | A1 | 3/2017 | Sollami | |
| 2017/0101867 | A1 | 4/2017 | Hall et al. | |

FOREIGN PATENT DOCUMENTS

| | | |
|---|---|---|
| DE | 202012100353 | 6/2013 |
| DE | 102015121953 | 7/2016 |
| DE | 102016118658 | 3/2017 |
| EP | 3214261 | 9/2017 |
| GB | 1114156 | 5/1968 |
| GB | 1218308 | 1/1971 |
| GB | 2483157 | 2/2012 |
| GB | 2534370 | 7/2016 |
| WO | 2008105915 A2 | 9/2008 |
| WO | 2008105915 A3 | 9/2008 |
| WO | 2009006612 | 1/2009 |

* cited by examiner

SECTION N-N

Detail R

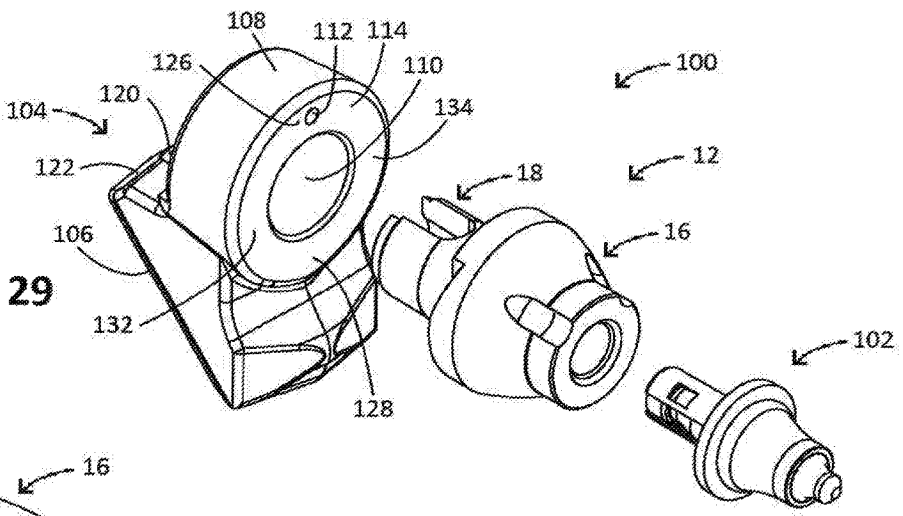
FIG. 29
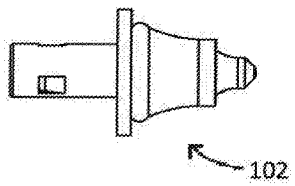
FIG. 30
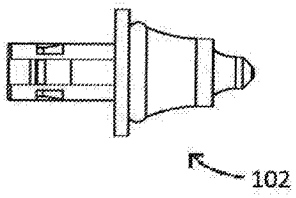
FIG. 31
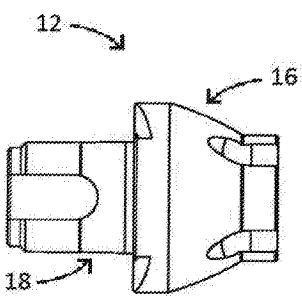
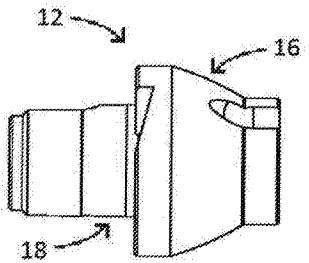
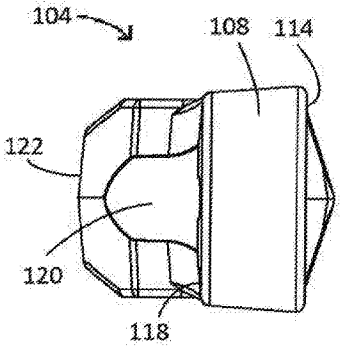
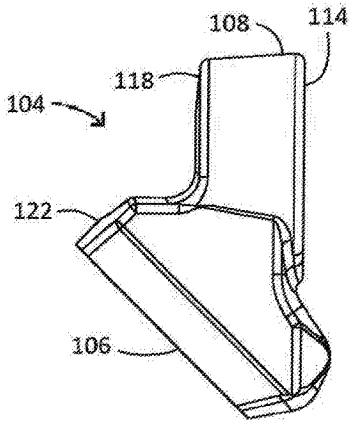

BIT HOLDER AND UNITARY BIT/HOLDER FOR USE IN SHORTENED DEPTH BASE BLOCKS

CROSS-REFERENCE TO RELATED APPLICATION(S)

This application claims priority to and is a continuation-in-part of U.S. Provisional Application No. 61/983,291, filed Apr. 23, 2014, claims priority to and is a continuation-in-part of U.S. Non-provisional application Ser. No. 14/690,679, filed Apr. 20, 2015, now U.S. Pat. No. 10,370,966, issued Aug. 6, 2019, claims priority to and is a continuation-in-part of U.S. Provisional Application No. 62/100,764, filed Jan. 7, 2015, and claims priority to and is a continuation-in-part of U.S. Non-provisional application Ser. No. 14/959,551, filed Dec. 4, 2015, now U.S. Pat. No. 10,337,324, issued Jul. 2, 2019, to the extent allowed by law and the contents of which are incorporated herein by reference in their entireties.

TECHNICAL FIELD

This disclosure relates to bit assemblies for road milling, mining, and trenching equipment, and more particularly, to a bit holder for use in shortened depth bore bit holder blocks.

BACKGROUND

Road milling, mining, and trenching equipment utilizes bits traditionally set in a bit assembly having a bit holder and a bit holder block. In one embodiment, the bit is retained by the bit holder and the bit holder is retained in the bit holder block. In another embodiment a unitary bit/holder is retained in the bit holder block. A plurality of the bit assemblies are mounted on the outside of a rotatable drum in staggered positions, typically in a V-shaped or spiral configuration, in an effort to create the smoothest road milling. The combinations of bit assemblies have been utilized to remove material from the terra firma, such as degrading the surface of the earth, minerals, cement, concrete, macadam or asphalt pavement. Individual bits, bit holders, and bit holder blocks may wear down or break over time due to the harsh road degrading environment. Additionally, the bit holder or the unitary bit/holder may be ejected out of the bit holder block bore due to the harsh road degrading environment. A need has developed to provide an improved bit holder and unitary bit/holder that makes a sufficient radial connection with the bit holder block bore to prevent the bit holder and/or unitary bit/holder from being ejected out of the bit holder block bore during harsh operations.

SUMMARY

This disclosure relates generally to bit assemblies for road milling, mining, and trenching equipment. One implementation of the teachings herein is a bit holder that includes a body having a bottom; and a generally cylindrical shank depending axially from the bottom of the body, the shank including: a top segment subjacent the bottom of the body, the top segment configured to make contact along a diameter with a bore of a base block; a mediate segment subjacent the top segment, the mediate segment including a taper towards the top segment; and an axially extending slot through a sidewall of the shank extending upwardly from a distal end of the shank.

One implementation of the teachings herein is a combination bit holder and base blocks that includes a base block including a receiving portion opposite a base, the receiving portion including a bore axially extending through the receiving portion; and a bit holder including a body having a bottom; and a generally cylindrical shank depending axially from the bottom of the body, the shank including: a top segment subjacent the bottom of the body, the top segment configured to make contact along a diameter with a bore of a base block; a mediate segment subjacent the top segment, the mediate segment including a taper towards the top segment; and an axially extending slot through a sidewall of the shank extending upwardly from a distal end of the shank.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

FIG. 29 is an exploded side perspective view of the second embodiment of the bit assembly, showing the bit, the bit holder, and the base block, in accordance with implementations of this disclosure;

FIG. 30 is an exploded top elevation view of the second embodiment of the bit assembly, showing the bit, the bit holder, and the base block, in accordance with implementations of this disclosure; and FIG. 31 is an exploded side elevation view of the second embodiment of the bit assembly, showing the bit, the bit holder, and the base block, in accordance with implementations of this disclosure.

DETAILED DESCRIPTION

Figure 1:
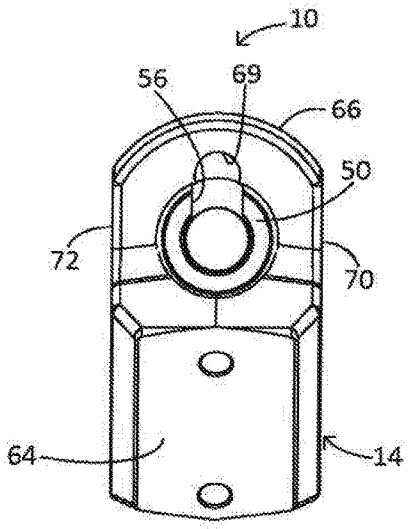
FIG. 1 is a rear elevation view of a first embodiment of a bit assembly, without a bit, showing a bit holder and bit holder block in accordance with implementations of this disclosure.

Road milling, mining, and trenching equipment utilizes bits traditionally set in a bit assembly having a bit holder and a bit holder block. In one embodiment, the bit is retained by the bit holder and the bit holder is retained in the bit holder block. In another embodiment a unitary bit/holder is retained in the bit holder block. A plurality of the bit assemblies are mounted on the outside of a rotatable drum in staggered positions, typically in a V-shaped or spiral configuration, in an effort to create the smoothest road milling. To provide a smoother surface, the size of the bit holder block can be reduced, such as by reducing the axial dimensions of the bit holder block, to allow the bit assemblies to be placed closer together. Such narrowed bit holder blocks, herein after referred to as base blocks, allow closer center-to-center axial bit tip position with the V-shaped or spiral configurations, thereby resulting in a smoother road surface. One important aspect of the present disclosure is providing a base block with narrowed dimensions to reduce the distance axial bit tip orientation. Another important aspect of the present disclosure is providing an improved bit holder and unitary bit/holder that makes a sufficient radial connection with a bore of the base block bore to prevent the bit holder and/or unitary bit/holder from being ejected out of the base block bore during harsh operations. A further important aspect of the present disclosure is providing an improved bit holder and unitary bit/holder that forms a sufficient interference fit to engage a continuous diameter of the base block bore.

Referring to FIGS. 1-18, a first embodiment of a bit assembly 10, without a bit, comprises a bit holder 12 and a base block 14. The bit holder 12 includes a bit holder body 16 and a shank 18 axially depending from the bottom of the bit holder body 16. The bit holder body 16 is generally annular in shape and comprises an annular or generally cylindrical upper body portion 20 axially extending from a flat annular top surface 22. Subjacent the upper body portion 20 is a middle portion 24 that extends axially and radially outwardly to a radially extending generally cylindrical tire portion 26. The middle portion 24, in this illustrated embodiment, has an arcuate shape. In other embodiments, the middle portion 24 can have a frustoconical shape, a convex shape, or a concave shape.

Figure 2:
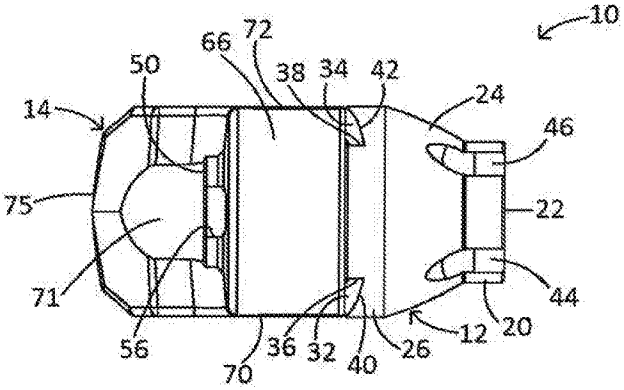
FIG. 2 is a top elevation view of the first embodiment of the bit assembly, without a bit, showing the bit holder and bit holder block in accordance with implementations of this disclosure.
Figure 3:
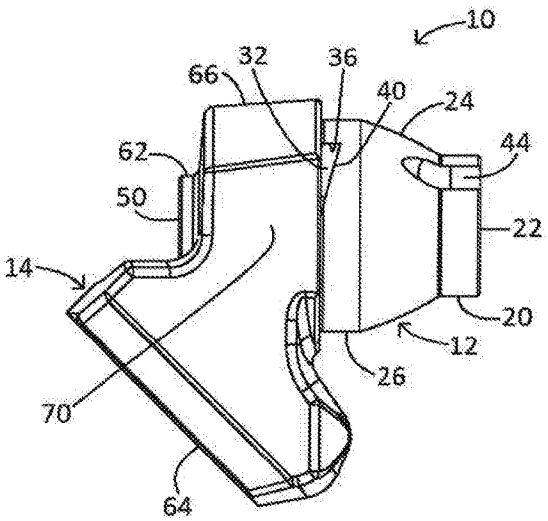
FIG. 3 is a side elevation view of the first embodiment of the bit assembly, without a bit, showing the bit holder and bit holder block in accordance with implementations of this disclosure.
Figure 4:
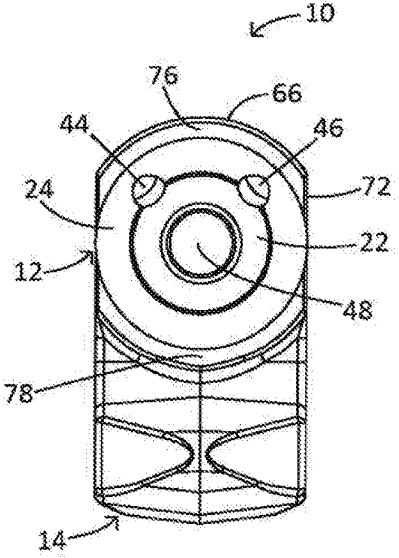
FIG. 4 is a front elevation view of the first embodiment of the bit assembly, without a bit, showing the bit holder and bit holder block in accordance with implementations of this disclosure.
Figure 7:
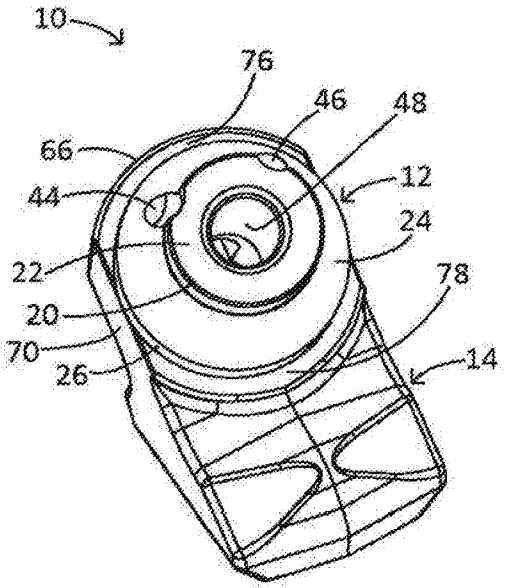
FIG. 7 is a front vertical perspective view of the first embodiment of the bit assembly, without a bit, showing the bit holder and bit holder block in accordance with implementations of this disclosure.
Figure 6:
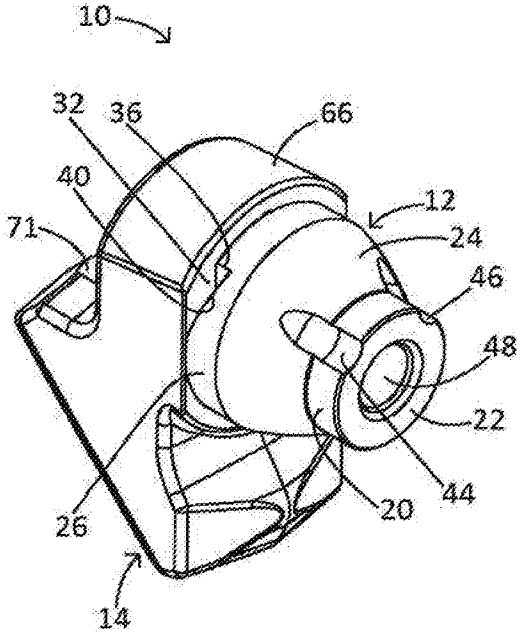
FIG. 6 is a front/side vertical perspective view of the first embodiment of the bit assembly, without a bit, showing the bit holder and bit holder block in accordance with implementations of this disclosure.
Figure 5:
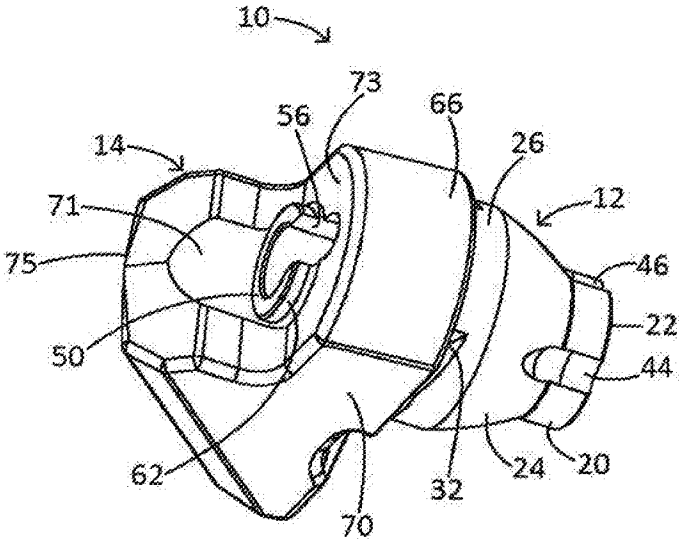
FIG. 5 is a rear horizontal perspective view of the first embodiment of the bit assembly, without a bit, showing the bit holder and bit holder block in accordance with implementations of this disclosure.
Figure 10:
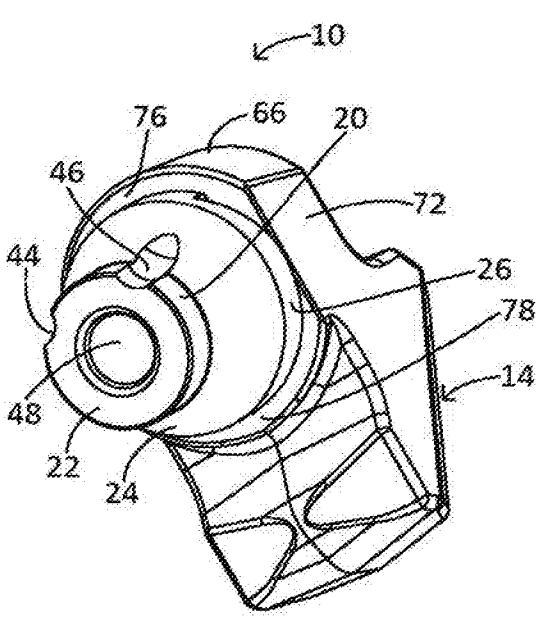
FIG. 10 is a front perspective view of the first embodiment of the bit assembly, without a bit, showing the bit holder and bit holder block in accordance with implementations of this disclosure.
Figure 9:
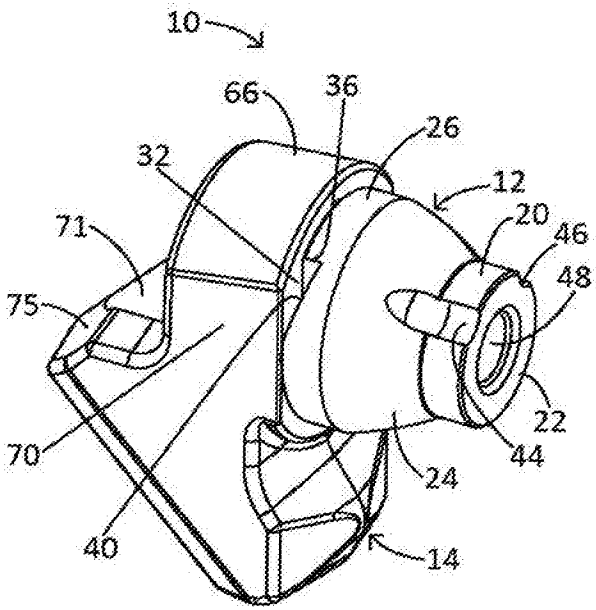
FIG. 9 is a side perspective view of the first embodiment of the bit assembly, without a bit, showing the bit holder and bit holder block in accordance with implementations of this disclosure.
Figure 8:
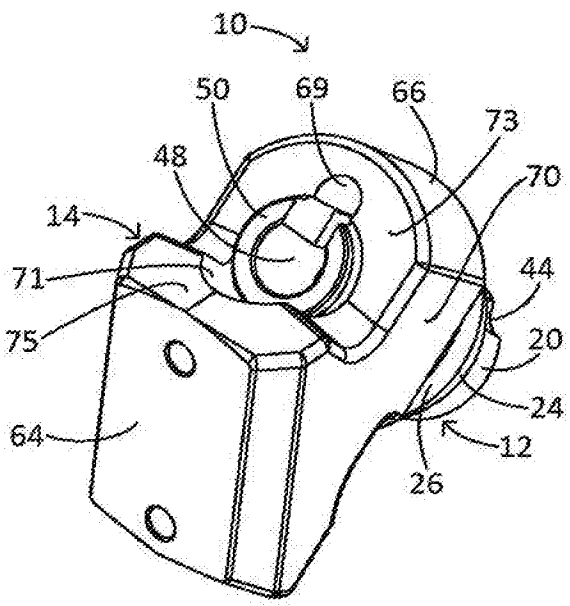
FIG. 8 is a rear perspective view of the first embodiment of the bit assembly, without a bit, showing the bit holder and bit holder block in accordance with implementations of this disclosure.
Figure 11:
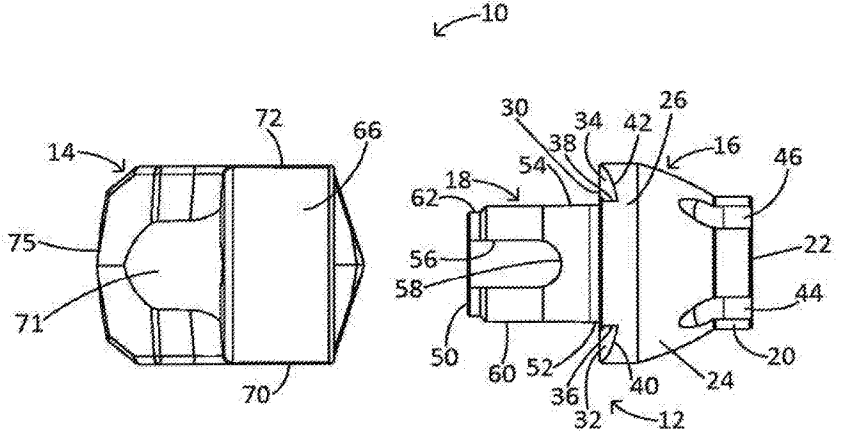
FIG. 11 is an exploded top elevation view of the first embodiment of the bit assembly, without a bit, showing the bit holder and bit holder block in accordance with implementations of this disclosure.
Figure 12:
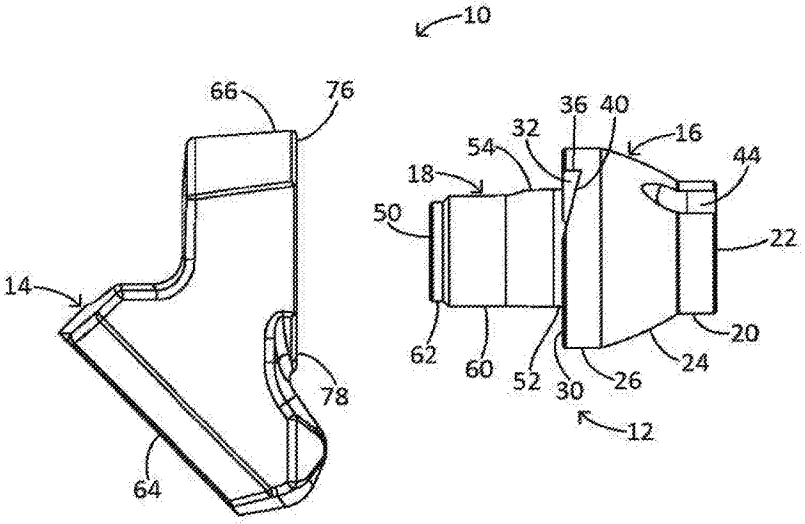
FIG. 12 is an exploded side elevation view of the first embodiment of the bit assembly, without a bit, showing the bit holder and bit holder block in accordance with implementations of this disclosure.
Figure 13:
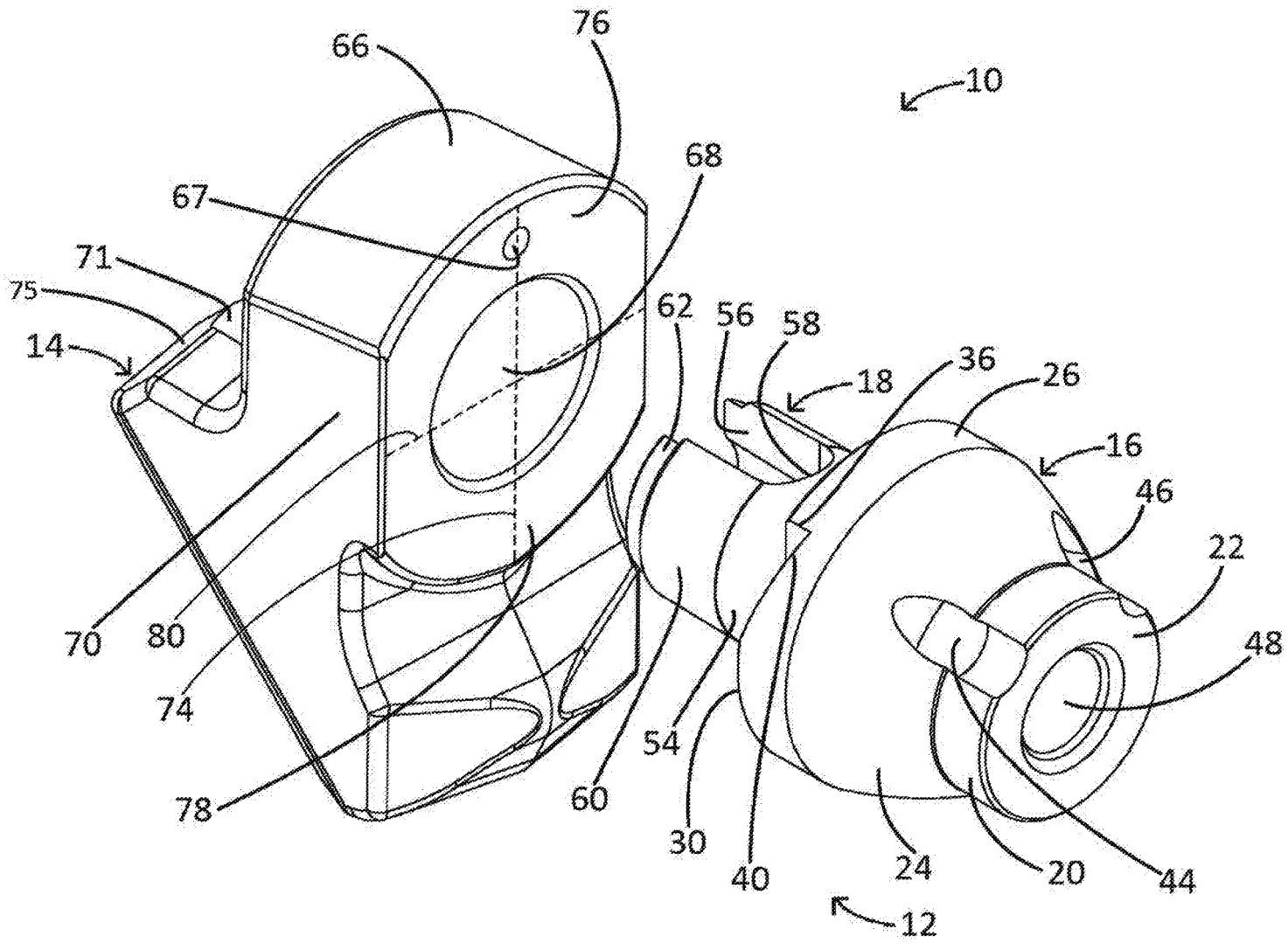
FIG. 13 is an exploded side perspective view of the first embodiment of the bit assembly, without a bit, showing the bit holder and bit holder block in accordance with implementations of this disclosure.
Figure 14:
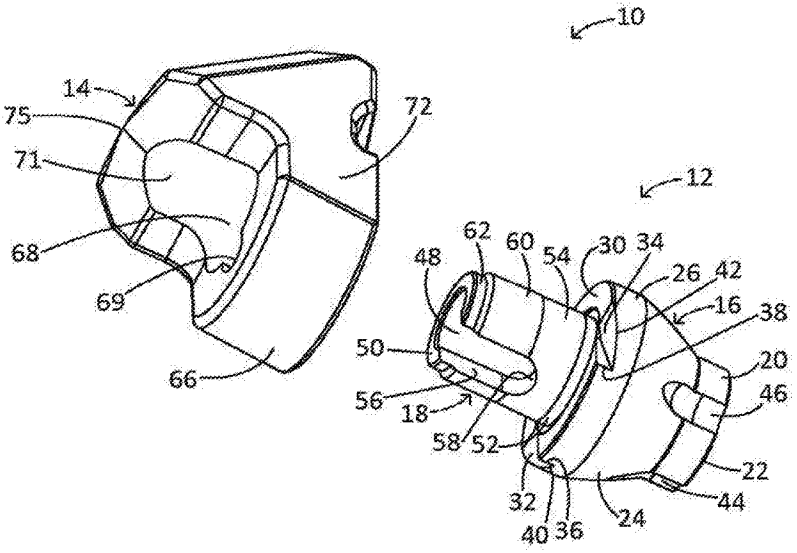
FIG. 14 is an exploded top/side perspective view of the first embodiment of the bit assembly, without a bit, showing the bit holder and bit holder block in accordance with implementations of this disclosure.
Figure 15:
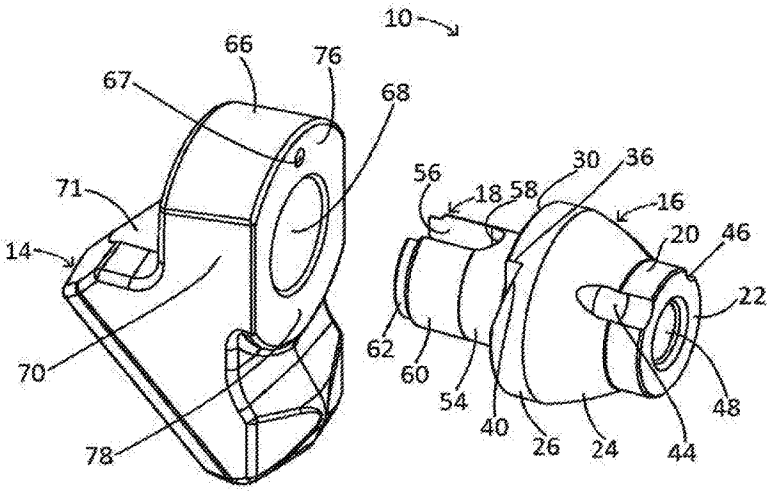
FIG. 15 is an exploded side perspective view of the first embodiment of the bit assembly, without a bit, showing the bit holder and bit holder block in accordance with implementations of this disclosure.
Figure 16:
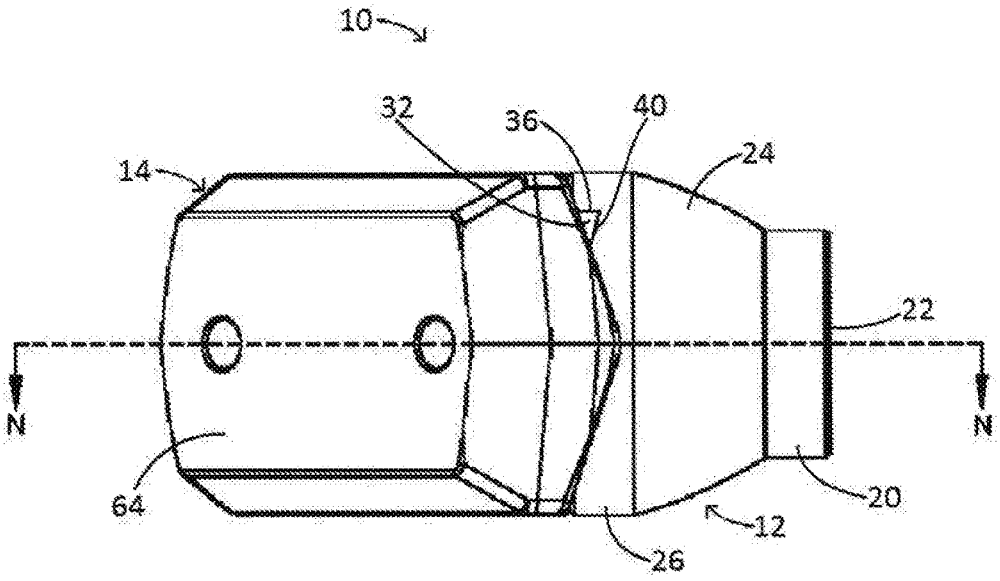
FIG. 16 is a bottom elevation view of the first embodiment of the bit assembly, without a bit, showing the bit holder and bit holder block in accordance with implementations of this disclosure.
Figure 17:
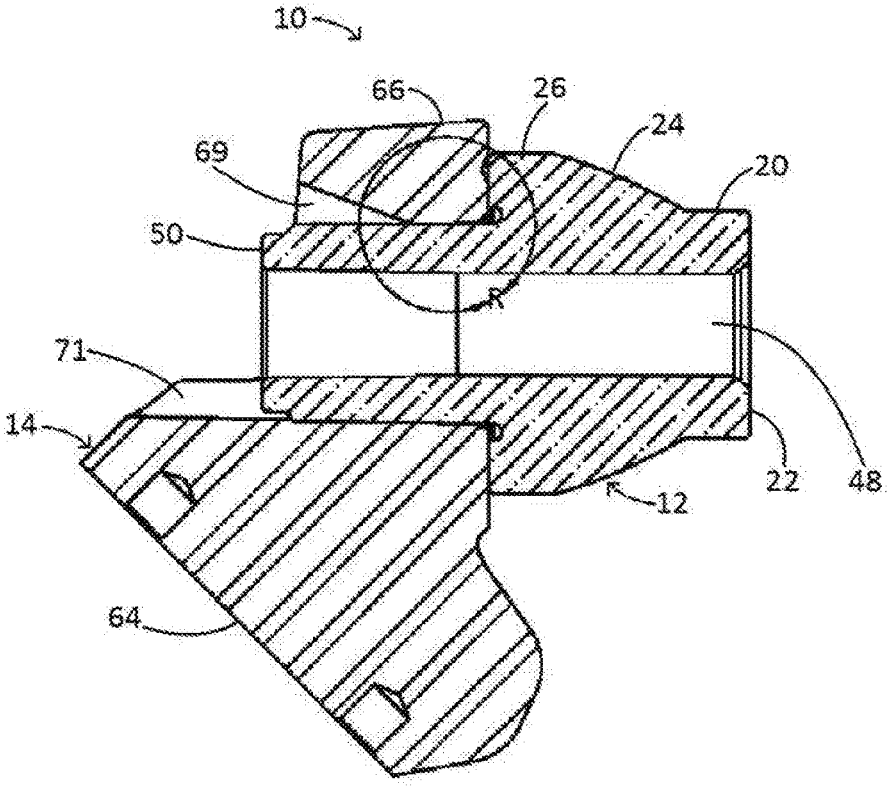
FIG. 17 is a cross-sectional side elevation view taken along Line N-N of FIG. 16 of the first embodiment of the bit assembly, without a bit, showing a bit holder and bit holder block in accordance with implementations of this disclosure.
Figure 18:
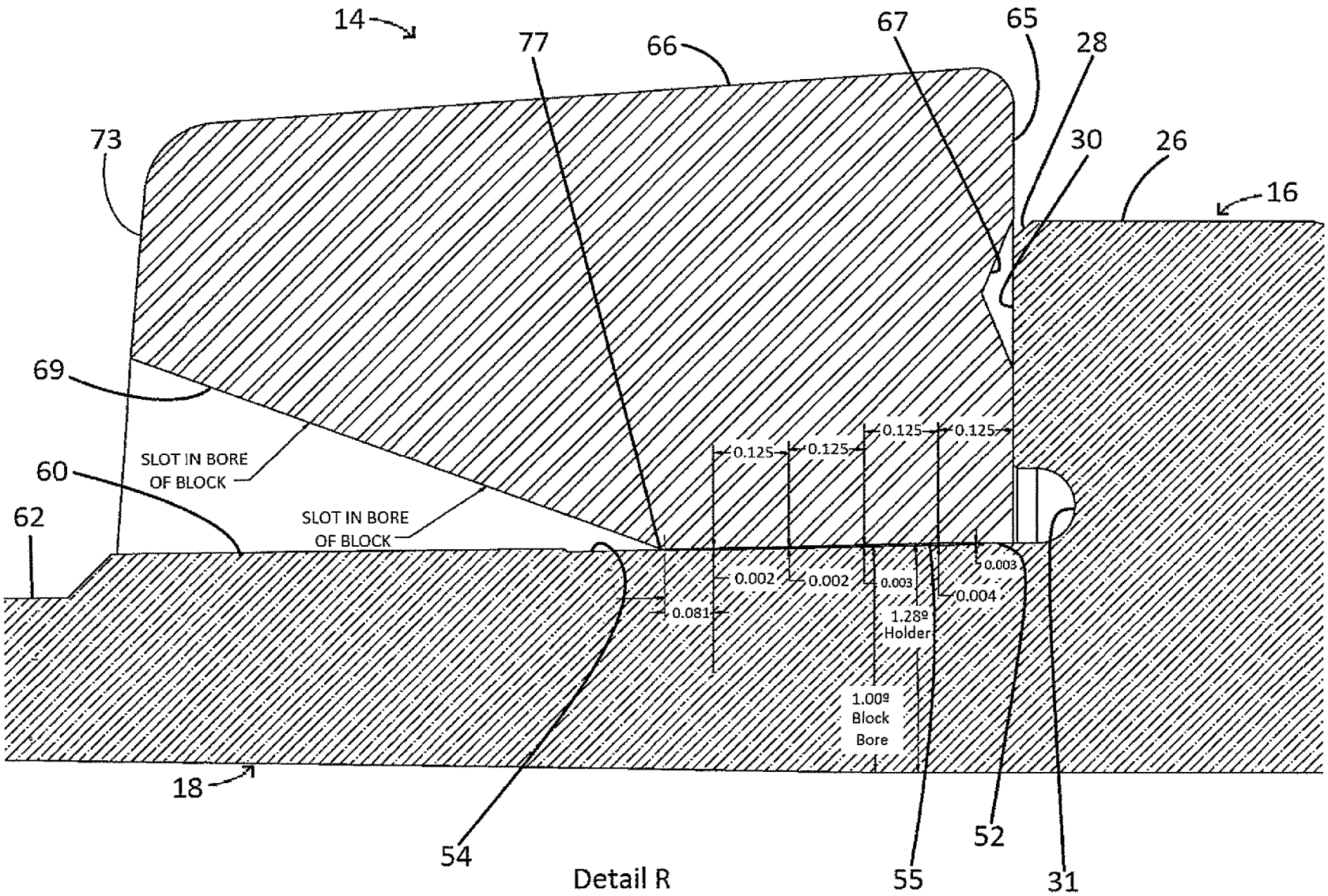
FIG. 18 is a detail cross-sectional side elevation view of the first embodiment of the bit assembly, without a bit, showing Detail R of the bit holder and bit holder block of FIG. 17 in accordance with implementations of this disclosure.
Figure 20:
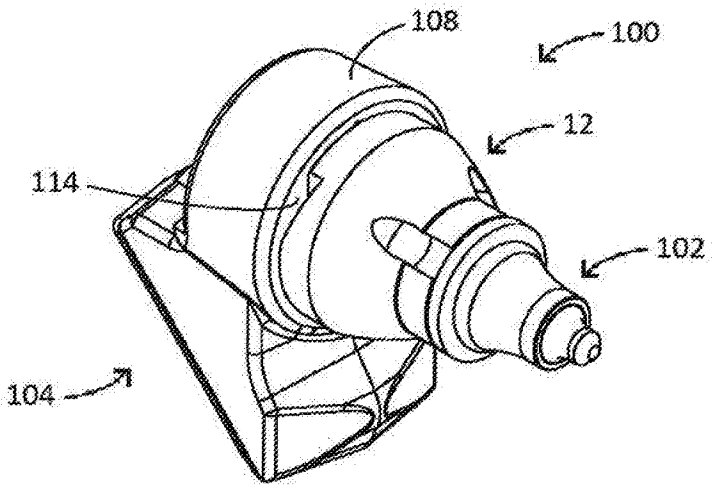
FIG. 20 is a side perspective view of the second embodiment of the bit assembly, showing a bit, bit holder, and base block in accordance with implementations of this disclosure.
Figure 19:
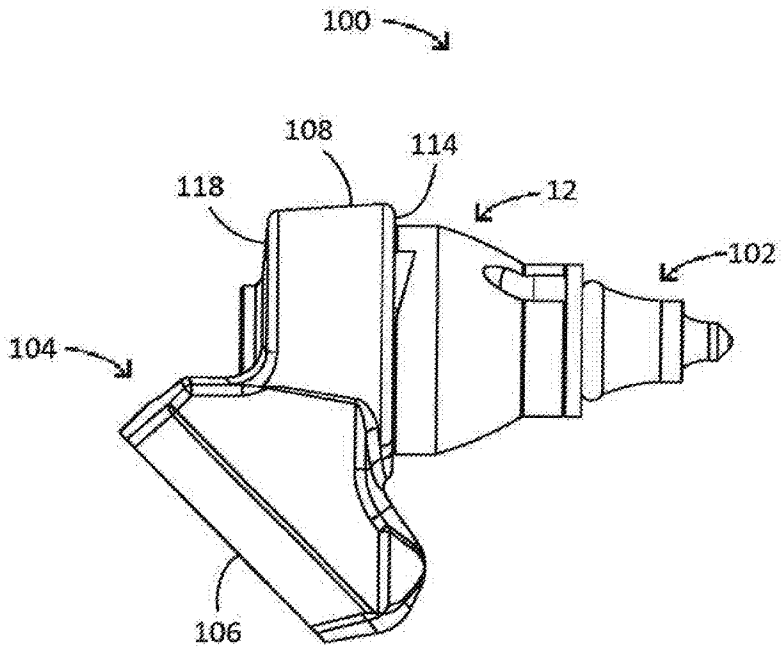
FIG. 19 is a side elevation view of a second embodiment of a bit assembly, showing a bit, a bit holder and a base block in accordance with implementations of this disclosure.

Adjacent the tire portion 26 is a tapered portion 28, shown in FIG. 18, that ends in a flange 30, such as a flat annular flange, shown in FIGS. 11-14 and 18, that denotes the bottom of the bit holder body 16. The tire portion 26 includes a pair of tapered cutouts 32, 34, or wedge-shaped undercuts, shown in FIGS. 2, and 11, to provide access and leverage for a tool to extract the bit holder 12 from the base block 14. The tapered cutouts 32, 34 are formed into the tire portion 26 and extend from the flange 30 subjacent to the tire portion 26. The tapered cutouts 32, 34 include a pair of parallel flat vertical inner surfaces 36, 38, respectively, as shown in FIGS. 2 and 11, and a pair of flat tapered top surfaces 40, 42, respectively, as shown in FIGS. 2 and 11. The outer edge of the flat tapered top surfaces 40, 42 is each arcuate in shape to follow the periphery of the tire portion 26. A pair of notches 44, 46, shown in FIGS. 2, 4-7, 9-11, and 13-15, are formed into the bit holder body 16 and extend from the flat annular top surface 22 through the upper body portion 20 and the middle portion 24, terminating at a point within the middle portion 24. The notches 44, 46 provide access and leverage for a tool to extract, or knock out, a bit from the bit holder body 16.

An outline of the bit holder 12 is shown in FIG. 18 beginning at the axially extending tire portion 26 to a generally rounded annular or generally cylindrical undercut 31 that extends to the a top segment 52 of the shank 18. The shank 18, shown in FIGS. 11-15 and 17, axially depends from the bit holder body 16. The bit holder body 16 and the shank 18 are axially aligned about a bit holder bore 48, shown in FIG. 17, that extends from the flat annular top surface 22 of the bit holder body 16 to a distal end 50 of the shank 18. The axial length of the shank can be greater, equal to, or less than an axial height of the bit holder body 16. The bit holder 12, in this illustrated embodiment, comprises the shortened shank 18 that includes an axial length of approximately 1½ inches. The shank 18 comprises a the increased diameter shortened top segment 52 that axially extends from the bit holder body 16. A decreased diameter mediate segment 54 is adjacent to the increased diameter top segment 52. The decreased diameter mediate segment 54 can have a generally cylindrical shape, an arcuate shape, or can be tapered 55 towards the increased diameter top segment 52 and/or towards the distal end 50 of the shank 18 as shown in this embodiment in FIG. 18. FIG. 18, which is a detail cross-sectional side elevation view of the shank 18 of the bit holder 12 inserted into a base block bore 68 of the base block 14, shows that the distance between the decreased diameter mediate segment 54 and the base block bore 68 increases from 0.002 to 0.003 to 0.004, meaning that a diameter of the decreased diameter mediate segment 54 initially decreases as it extends toward the increased diameter shortened top segment 52. FIG. 18 further shows that the distance between the decreased diameter mediate segment 54 and the base block bore 68 then decreases from 0.004 to 0.003, meaning that the diameter of the decreased diameter mediate segment 54 then increases as it extends to a location adjacent a distal end of the increased diameter shortened top segment 52. A slot 56, shown in FIGS. 11, and 13-15, extends from an upper termination 58 in the decreased diameter mediate segment 54 to the distal end 50 of the shank 18. Adjacent the decreased diameter mediate segment 54 is an axially extending lower tapered segment 60 adjacent a decreased diameter distal segment 62. The lower tapered segment 60 includes what is termed herein a "reverse taper portion", such that the lower tapered segment 60 tapers outwardly as it axially extends to a decreased diameter distal segment 62. The decreased diameter distal segment 62 axially extends to the distal end 50 of the shank 18 and is generally C-shaped when viewed from the distal end 50.

There is a standard interference between the increased diameter shortened top segment 52 of the shank 18 of the bit holder 12 and a corresponding portion of the base block bore 68. This upper top segment 52 may, in another embodiment, be tapered to conform with the angle of taper of the top of the base block bore 68 to provide an annular surface interference rather than an annular line interference. The lower tapered segment 60 includes a reverse taper that increases toward the bottom end of the lower tapered segment 60. This "reverse taper" only has to be a less tapered portion than that of the adjacent corresponding portion of the base block bore 68. In other words, if the taper that portion of the base block bore 68 is one degree per side, the reverse taper of the lower tapered segment 60 would only have to be something less than that, i.e., ½ degree per side. If the base block bore 68 is cylindrical, the reverse taper portion of the lower tapered segment 60 would only have to be a negative taper of ½ degree, 1 degree, etc. per side. The reason for the reverse taper is to move the position at which a greater interference force is exerted at the distal end 50 of the shank 18. By using a lesser taper on the bit holder shank 18 that that of the base block bore 68, the area of greater interference or holding force between the base block bore 68 and the bit holder shank 18 may be moved lower on the shank near distal end 50 and may also be spread over a greater axial length than that utilized in the prior art.

The base block 14 comprises a base 64 and a shortened front end 66. The base 64 can be flat or slightly concave to fit a drum or additional mounting plates on which a singular or a plurality of base blocks can be mounted. The shortened front end 66 includes a base block bore 68, shown in FIGS. 13 and 15, that is symmetrical with the shank 18 along a centerline. The shortened front end 66 and the base block bore 68 extending axially through the shortened front end 66 are shortened to approximately 1.5 inches in length, in this embodiment, by removing material from the rear of the shortened front end 66. The shortened front end 66 includes, in this embodiment, an indentation 67 (FIGS. 13, 15, and 18) on a front face 65 (FIG. 18) of the base block 14. The shortened front end 66 also includes, in this embodiment, a slot 69 (FIGS. 8, 17, and 18) decreasing in radial size from a rear face 73 (FIG. 18) of the shortened front end 66 to a position mediate the front face 65. The slot 69 provides added room for a punch (not shown) to operate and push the shank of a bit out of the bit holder.

The base block 14 also includes an arcuate bore 68 extension 71 (FIGS. 5, 8, 11, 13-15, and 18) starting at an inner portion of the base block bore 68 subjacent the rear face 73 of the shortened front end 66 and extending toward a rear 75 (FIGS. 2, 5, 8, 9, 11, 13, and 14) of the base block 14. The extension 71 does not serve a function when the base block 14 is used with a shortened shank bit holder 12. A bit holder having a shortened 1½ inch long shank that shows sufficient wear that it needs to be replaced may not only be replaced with another bit holder having a 1½ inch long shank but may also be replaced by what may be termed a standard "quick change" bit holder having a 2⅝ inch long shank. Over time the extreme forces from cutting conditions will wear the base block bore 68 and bit holder shank 18 such that the shortened shank bit holder 12 may not successfully be retained in the base block bore 68 and the shortened shank bit holder 12 must be replaced with a standard 2⅝ inch length shank bit holder (not shown). The extension 71 engages the 2⅝ inch long shank of the standard bit holder adjacent its distal end and provides sufficient sideways force against that portion of the shank to retain the standard bit holder in the base block 14.

The shortened front end 66 also includes a pair of flat vertical sides 70, 72, shown in FIGS. 1, 4-6 and 9-13, and 15, that extend near and/or adjacent the base 64. The flat vertical sides 70, 72 reduce the dimensions of the base block 14 width and allow bit assemblies to be positioned in closer center-to-center axial bit tip orientation in order to degrade the road to a smoother surface. A vertical distance 74, shown in FIG. 13, between a top portion 76 and a bottom portion 78 of the shortened front end 66 is greater than a horizontal distance 80, shown in FIG. 13, between the flat vertical sides 70, 72 of the shortened front end 66.

Figure 24:
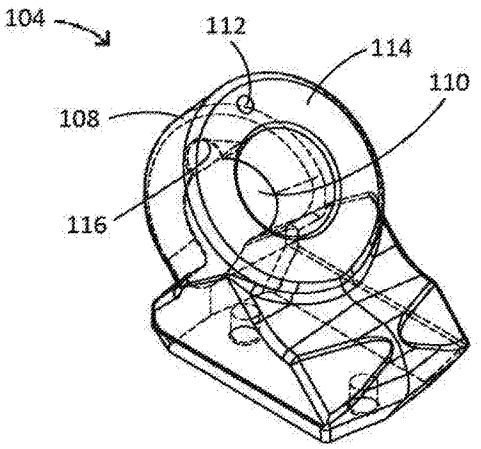
FIG. 24 is a side perspective view of the base block of the second embodiment of the bit assembly in accordance with implementations of this disclosure.
Figure 23:
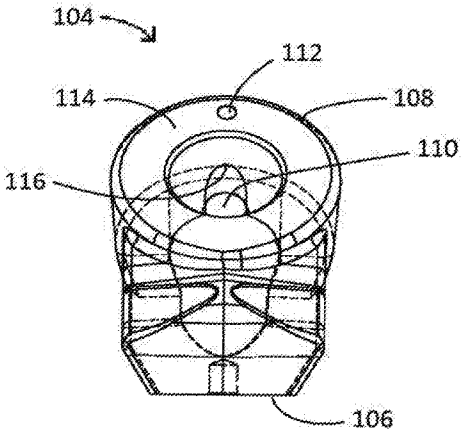
FIG. 23 is a front perspective view of the base block of the second embodiment of the bit assembly in accordance with implementations of this disclosure.
Figure 22:
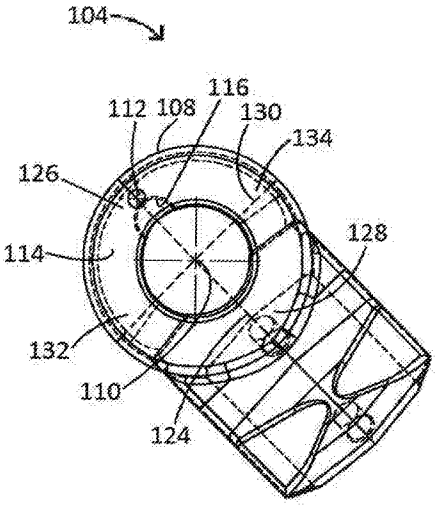
FIG. 22 is a front elevation view of the base block of the second embodiment of the bit assembly, taken along Axis A of FIG. 21, in accordance with implementations of this disclosure.
Figure 21:
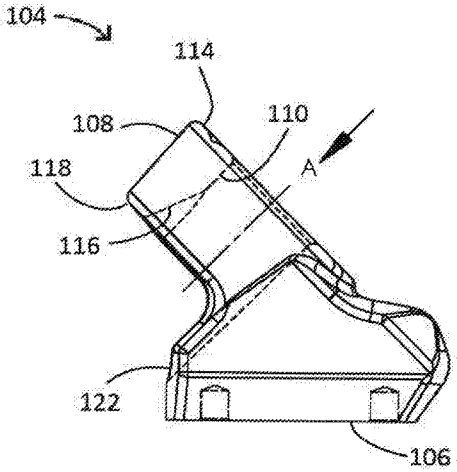
FIG. 21 is a side elevation view of the base block of the second embodiment of the bit assembly in accordance with implementations of this disclosure.
Figure 26:
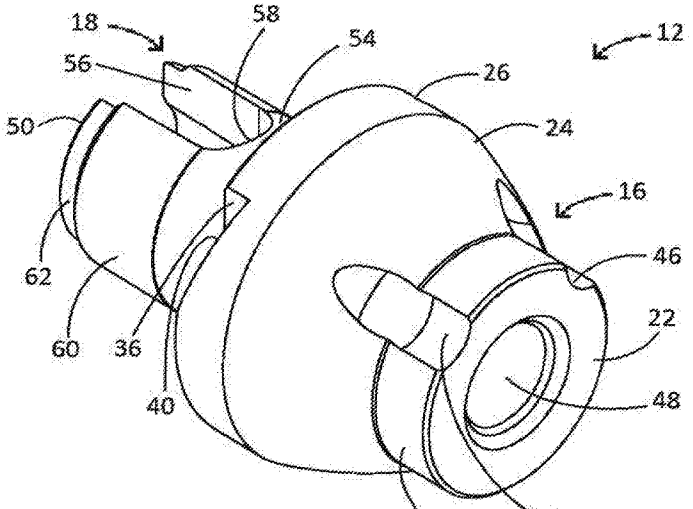
FIG. 26 is a side perspective view of the bit holder of the second embodiment of the bit assembly in accordance with implementations of this disclosure.
Figure 28:
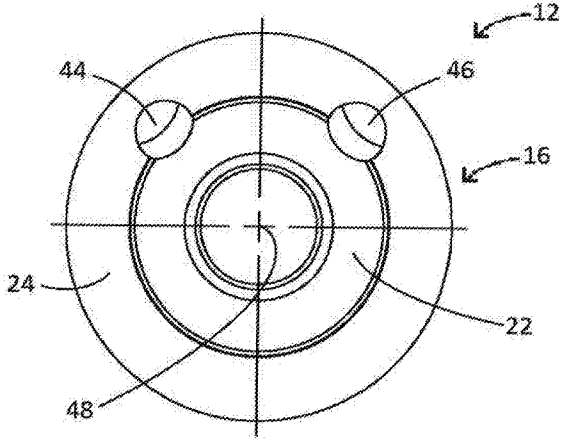
FIG. 28 is a front elevation view of the bit holder of the second embodiment of the bit assembly in accordance with implementations of this disclosure.
Figure 25:
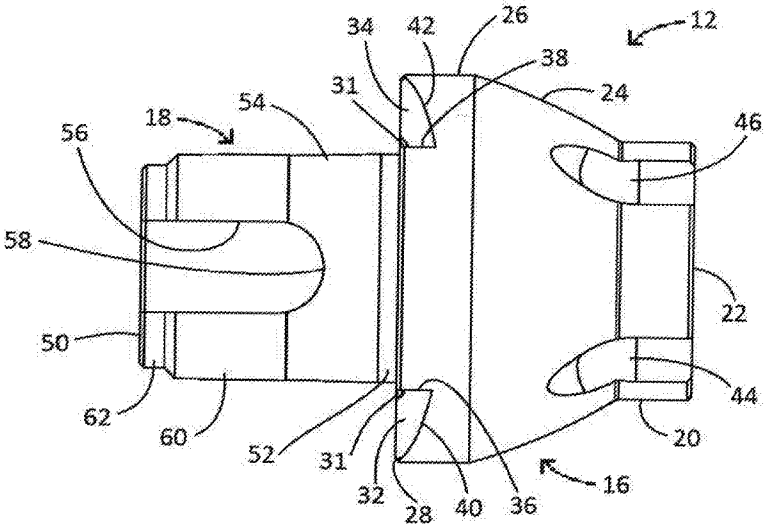
FIG. 25 is a top elevation view of the bit holder of the second embodiment of the bit assembly in accordance with implementations of this disclosure.
Figure 27:
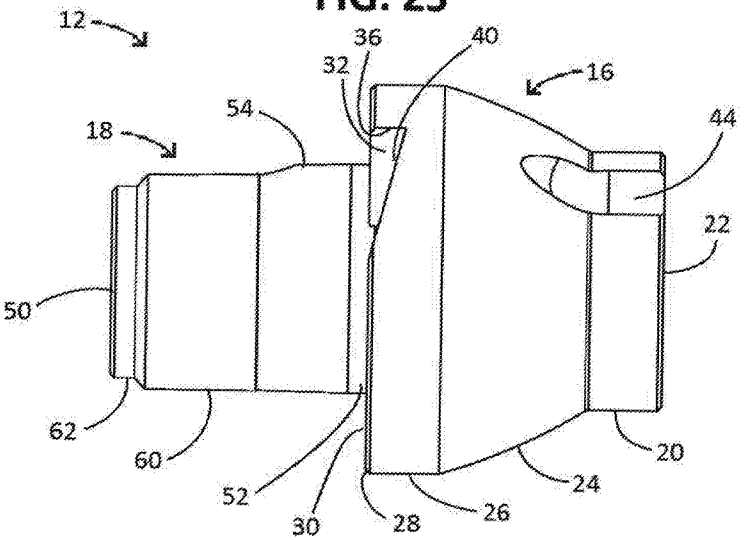
FIG. 27 is a side elevation view of the bit holder of the second embodiment of the bit assembly in accordance with implementations of this disclosure.

Referring to FIGS. 19-31, a second embodiment of a bit assembly 100, shown with a bit 102 in FIGS. 19, 20, and 29-31, comprises the bit holder 12, as described in the first embodiment of the bit assembly 10, and a base block 104. The base block 104 comprises a base 106 and a shortened front end 108. The base 106 can be flat or slightly concave to fit a drum or additional mounting plates on which a singular or a plurality of base blocks can be mounted. The shortened front end 108 includes a base block bore 110, shown in FIGS. 22-24 and 29, that is symmetrical with the shank 18 along a centerline. The shortened front end 108 and the base block bore 110 extending axially through the shortened front end 108 are shortened to approximately 1.5 inches in length, in this embodiment, by removing material from the rear of the shortened front end 108. The shortened front end 108 includes, in this embodiment, an indentation 112 (FIGS. 22-24 and 29) on a front face 114 of the base block 104. The shortened front end 108 also includes, in this embodiment, a slot 116 (FIGS. 22-24) decreasing in radial size from a rear face 118 (FIG. 21) of the shortened front end 108 to a position mediate the front face 114. The slot 116 provides added room for a punch (not shown) to operate and push the shank of the bit 102 out of the bit holder 12.

The base block 104 also includes an arcuate bore 110 extension 120 (FIG. 30) starting at an inner portion of the base block bore 110 subjacent the rear face 118 of the shortened front end 108 and extending toward a rear 122 (FIG. 30) of the base block 104. As mentioned in the first embodiment, the extension 120 does not serve a function when the base block 104 is used with a shortened shank bit holder 12. Once the shortened shank bit holder 12 is not able to be successfully retained in the base block bore 110, the shortened shank bit holder 12 is replaced with a standard 2⅝ inch length shank bit holder (not shown). The extension 110 engages the 2⅝ inch long shank of the standard bit holder adjacent its distal end and provides sufficient sideways force against that portion of the shank to retain the standard bit holder in the base block 104.

The perimeter of the front face 114 of the shortened front end 108 is annular, circular, or cylindrical, in this embodiment, and the front face 114 is perpendicular to the base block bore 110. A vertical distance 124, shown in FIG. 22, between a top portion 126 and a bottom portion 128 of the shortened front end 108 is approximately the same as or equal to a horizontal distance 130, shown in FIG. 22, between a first side portion 132 and a second side portion 134 of the shortened front end 108.

When assembled, slot 56 allows the shank 18 to radially compress when inserted into the first embodiment or the second embodiment of the base block bore 68, 110 of the shortened front end 66, 108, respectively, forming a sufficient interference fit to engage a continuous diameter between the shank 18 and the base block bore 68, 110, respectively. The force between the diametrically contracted shank 18 and the base block bore 68, 110 maintains and retains the bit holder 12 in the base block 14, 104 and provides a sufficient radial connection to prevent the shank 18 from moving out of the base block bore 68, 110 during use. Furthermore, top segment 52 of the shank 18 provides additional radial compression force and additional contact between the top segment 52 and the base block bore 68, 110, thereby allowing for a greater increase of radial contact which results in a higher distributed radial force maintaining the shank 18 within the bore 68, 110 of the base block 14, 104, respectively. At least ⅓ of the axial length, and/or at least ½ inch, of the shank 18 between the flange 30 and the distal end of the top segment 52 of the shank 18, or a forward end 77 (FIG. 18) of the slot 69, in this illustrated embodiment, contacts the bore 68, 110 of the base block 14, 104, respectively, and provides greater radial length contact resulting in greater radial force. The interference contact zones between the tapered bore 68, 110 of the base block 14, 104, respectively, and the corresponding surface of the shank 18 is at least 50% of the available axial contact length of the distal end portion of the shank 18 and at least 50% of the available axial contact length of the forward portion of the shank 18. The bit holder 12 and the base block 14, 104 are assembled together to form the bit assembly 10, 100, respectively. The bit holder 12, including the bit holder body 16, shank 18, and bit holder bore 48, and the base block 14, 104, including the base 64, 106, shortened front end 66, 108, and base block bore 68, 110, respectively, are all axially aligned when assembled together to form the bit assembly 10.

While the present disclosure has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A bit holder comprising:

a body comprising a bottom and an annular undercut disposed within the bottom; and a generally cylindrical shank depending axially from the bottom of the body, the shank comprising:

a top segment axially extending from the annular undercut, the top segment subjacent the bottom of the body, at least one of at least ⅓ of an axial length of the top segment and at least ½ inch of the axial length of the top segment adapted to make an interference fit along a circumference with a corresponding portion of a bore of a base block;

a mediate segment adjacent the top segment, the mediate segment being inwardly tapered from a distal end of the mediate segment towards a first location and being outwardly tapered from the first location towards a second location subjacent a distal end of the top segment, a diameter of the mediate segment at the first location being less than a diameter of the top segment; and an axially extending slot through a sidewall of the shank extending upwardly from a distal end of the shank.

2. The bit holder of claim 1, wherein an axial length of the body is greater than an axial length of the shank.

3. The bit holder of claim 1, further comprising:

a lower segment adjacent the mediate segment, the lower segment tapered outwardly as it axially extends towards the distal end of the shank; and a distal segment adjacent the lower segment and adjacent the distal end of the shank.

4. The bit holder of claim 3, wherein the lower segment is adapted to make an interference fit at a first corresponding location of the bore of the base block and the top segment is adapted to make an interference fit at a second corresponding location of the bore of the base block.

5. The bit holder of claim 3, wherein a first diameter of the lower segment is greater than a second diameter of the distal segment.

6. The bit holder of claim 3, wherein at least 50% of an axial length of the lower segment is adapted to form an interference fit with a corresponding portion of the bore of the base block.

7. The bit holder of claim 1, wherein a first diameter of the top segment is at least a second diameter of the mediate segment.

8. The bit holder of claim 1, further comprising:

a flange on the bottom of the body, the flange laterally extending from the annular undercut, the annular undercut comprising one of an annular rounded undercut and a cylindrical rounded undercut.

9. The bit holder of claim 1, further comprising:

a central bore extending axially inwardly from the distal end the shank to a forward end of the body.

10. The bit holder of claim 1, wherein an axial length of the shank is at least an axial length of the body.

11. The bit holder of claim 1, wherein an axial length of the body is one of less than and equal to an axial length of the shank.

12. The bit holder of claim 1, wherein an axial length of the shank is approximately 1 ½ inches.

13. The bit holder of claim 1, wherein at least 50% of the axial length of the top segment is adapted to form an interference fit with a corresponding portion of the bore of the base block.

14. A combination bit holder and base block comprising:

a base block comprising a receiving portion opposite a base, the receiving portion including a bore axially extending through the receiving portion; and a bit holder comprising:

a body comprising a bottom and an annular undercut disposed within the bottom; and a generally cylindrical shank depending axially from the bottom of the body, the shank comprising:

a top segment axially extending from the annular undercut, the top segment subjacent the bottom of the body, at least one of at least ⅓ of an axial length of the top segment and at least ½ inch of the axial length of the top segment adapted to make an interference fit along a circumference with a corresponding portion of the bore of the base block;

a mediate segment adjacent the top segment, the mediate segment being inwardly tapered from a distal end of the mediate segment towards a first location and being outwardly tapered from the first location towards a second location subjacent a distal end of the top segment, a diameter of the mediate segment at the first location being less than a diameter of the top segment; and an axially extending slot through a sidewall of the shank extending upwardly from a distal end of the shank.

15. The combination of claim 14, wherein an axial length of the body is greater than an axial length of the shank.

16. The combination of claim 14, further comprising:

a lower segment adjacent the mediate segment, the lower segment tapered outwardly as it axially extends towards the distal end of the shank; and a distal segment adjacent the lower segment and adjacent the distal end of the shank.

17. The combination of claim 16, wherein the lower segment is adapted to make an interference fit at a first corresponding location of the bore of the base block and the top segment is adapted to make an interference fit at a second corresponding location of the bore of the base block.

18. The combination of claim 16, wherein a first diameter of the lower segment is greater than a second diameter of the distal segment.

19. The combination of claim 16, wherein a first diameter of the top segment is at least a second diameter of the mediate segment.

20. The combination of claim 16, wherein at least 50% of an axial length of the lower segment is adapted to form an interference fit with a corresponding portion of the bore of the base block.

21. The combination of claim 14, further comprising:

a flange on the bottom of the body, the flange laterally extending from the annular undercut, the annular undercut comprising one of an annular rounded undercut and a cylindrical rounded undercut.

22. The combination of claim 14, further comprising:

a central bore extending axially inwardly from the distal end the shank to a forward end of the body.

23. The combination of claim 14, wherein the receiving portion includes one of a pair of flat vertical sides and a pair of rounded sides extending from the receiving portion to the base.

24. The combination of claim 14, further comprising:

an extension of an arcuate segment of the bore extending from a rear of the receiving portion, the extension of the arcuate segment of the bore providing an interference with a device capable of being securely mounted through the bore and outwardly of a rear of the receiving portion.

25. The combination of claim 14, wherein an axial length of the shank is at least an axial length of the body.

26. The combination of claim 14, wherein an axial length of the body is one of less than and equal to an axial length of the shank.

27. The combination of claim 14, wherein an axial length of the shank is approximately 1½ inches.

28. The combination of claim 14, wherein at least 50% of the axial length of the top segment is adapted to form an interference fit with a corresponding portion of the bore of the base block.

29. The combination of claim 14, further comprising:

a semi-circular angled slot extending inwardly from a rear face of the receiving portion, the slot enclosed within a sidewall of the receiving portion, the slot decreasing in size from the rear face of the receiving portion to a position mediate a front face of the receiving portion and the rear face of the receiving portion.

30. The combination of claim 14, further comprising:

an indentation disposed on a front face of the receiving portion axially above the bore.

31. The combination of claim 14, wherein at least one of the receiving portion and the bore comprise an axial length of approximately 1½ inches.

* * * * *